US006422339B1

(12) United States Patent
Wisler

(10) Patent No.: US 6,422,339 B1
(45) Date of Patent: Jul. 23, 2002

(54) WALL JACK

(76) Inventor: Richard Wisler, 19202 Sunlake Blvd., Lutz, FL (US) 33549

( * ) Notice: Subject to any disclaimer, the term of this patent is extended or adjusted under 35 U.S.C. 154(b) by 0 days.

(21) Appl. No.: 09/845,492

(22) Filed: May 1, 2001

Related U.S. Application Data

(60) Provisional application No. 60/230,715, filed on Sep. 7, 2000.

(51) Int. Cl.[7] ..... E04G 3/00
(52) U.S. Cl. ..... 182/82; 182/150
(58) Field of Search ..... 182/82, 150

(56) References Cited

U.S. PATENT DOCUMENTS

| | | | |
|---|---|---|---|
| 2,295,995 | A | 9/1942 | Lamb |
| 2,988,181 | A | 6/1961 | Darrey |
| 3,134,567 | A | 5/1964 | Shoemaker |
| 3,595,510 | A | 7/1971 | Hutchinson |
| 4,122,916 | A | 10/1978 | Strobel |
| 5,503,358 | A | 4/1996 | Lapp |
| 5,524,727 | A | 6/1996 | Yennie, Jr. |
| 5,829,549 | A | 11/1998 | Flynn |
| 6,003,631 | A | 12/1999 | Knauth |

FOREIGN PATENT DOCUMENTS

| | | |
|---|---|---|
| FR | 2428121 | 1/1980 |
| GB | 2 147 345 A | 5/1985 |

*Primary Examiner*—Alvin Chin-Shue
(74) *Attorney, Agent, or Firm*—Richard C. Litman

(57) ABSTRACT

A wall jack unit for erecting scaffolding is described having a series of brackets for placement at the top of a wall and connects with a wall surface-engaging pole and truss support structure with a combination user platform for supporting a wood plank between at least two of the units. Each part has adjustable features which utilize hole-engaging connections so that a series of units can be joined or formulated on a variety of building or wall structures. The unit is made of a durable steel which is resistant to weather ladened effects.

6 Claims, 3 Drawing Sheets

WALL JACK

CROSS-REFERENCE TO RELATED APPLICATION

This application claims the benefit of U.S. Provisional Patent Application Ser. No. 60/230,715, filed Sep. 7, 2000.

BACKGROUND OF THE INVENTION

1. Field of the Invention

The present invention relates generally to scaffolding. More specifically, the invention is a wall jack used for numerous scaffolding purposes.

2. Description of Related Art

Numerous scaffolding structures have been devised for improving workability in and around buildings and similar structures during construction thereof. One of the main problems with the deployment of scaffolding is the time and labor required to effectively erect the structure. In many instance, the deployment of a typical scaffolding network includes not only cost in labor, but cost in planning to produce a scaffolding system which is secure and reduces liabilities which may be related to mechanical failure. In this regard, the wall jack system herein described is simple to use and easy to deploy for erecting scaffolding for various construction purposes. The wall jack system unlike conventional scaffolding described hereinbelow does not require the use of mechanical fasteners for securing the structure to a wall or similar structure during construction thereof.

For example, U.S. Pat. No. 2,295,995 issued to Lamb discloses a safety scaffold which mounts to a chimney. The scaffold includes a supporting cable having a plurality of spaced blocks secured thereto via a set of interconnected braces and wooden posts. A triangular shaped scaffolding structure is mechanically secured to the wall via bolt fasteners at top and bottom portions, wherein the hypotenuse portion of the structure extends away from the chimney wall and includes an arcuate support bar mounted therewith as an integral structure. The wooden posts are mechanically secured to braces via a plurality of mechanical bolt and screw fasteners for retaining or supporting wooden platforms.

U.S. Pat. No. 2,988,181 issued to Darrey discloses a scaffold comprising spaced upright tubular members with adjustable insertable tubular elements. Each upright support is secured to a wall via L-shaped brackets permanently secured thereto by welding. The L-shaped brackets are provided with threaded apertures to receive threaded hooks which can be readily looped about a building member. The upright tubular members are adjusted vertically via two rows of oppositely spaced apertures disposed along the length thereof and stabilized by pins. A horizontal beam or A-frame member having first and second tubular members is insertably attached between the upright tubular member attached to a building member and a second upright member vertically mounted in direct alignment therewith for supporting a support board at one end of the scaffold. With the pins remove, the A-frame is adjusted vertically while constrained along and between the upright tubular members.

U.S. Pat. No. 3,134,567 issued to Shoemaker discloses a scaffolding support having a single suspension from or hanger with a hook at its upper end and a series of adjustable openings along its length. Mounted for lengthwise adjustment on the hanger is a sleeve having a notch in its lower end for reception of a pin. Integral with the sleeve is carried an arm or shoe having notches, one of which is adapted for the reception of a pin connecting a pair of spaced plates connecting horizontal and vertical legs and joined at their outer ends by a leg of a triangular bracket or jack.

U.S. Pat. No. 3,595,510 issued to Hutchinson discloses an inverted L-shaped wall supported scaffold brace member comprising a first horizontal leg having inner and outer ends and projecting horizontally outwardly from a wall structure at its outer end. A second vertical leg of the brace member depends from the inner end of the first leg downwardly along the outer surface of the wall structure. The first leg defines a tubular receiver, square in cross-section and a tension arm which is also square in cross-section and is slidably received in the receiver in select angular positions. The tension arm includes, on its end projecting outwardly of the inner end of the horizontal leg, a lateral abutment portion for engagement with the inner surface wall structure adjacent an opening in the wall structure through which the tension arm extends. U.S. Pat. No. 4,122,916 issued to Strobel discloses a similar scaffolding structure, except that an upright fixed adjacent to the support board is intersected by the top surface of the roof and secured therethrough via mechanical fasteners disposed within and through the shingles.

Other wall type scaffolding structures of conventional construction are described in patents issued to Lapp (U.S. Pat. No. 5,503,358), Yennie, Jr. (U.S. Pat. No. 5,524,727), Flynn (U.S. Pat. No. 5,829,549), Knauth (U.S. Pat. No. 6,003,631) and Jorrey (FR 7817715) and Rack (GB 2147345) Neither of these patents teach a combination wall and truss support wall jack as herein described. Thus, none of the above inventions and patents, taken either singly or in combination, is seen to describe the instant invention as claimed.

SUMMARY OF THE INVENTION

The wall jack unit according to the present invention is used for scaffolding purposes and includes a joist-engaging bracket or element for placement at the top of a wall that connects with a wall surface-engaging element, which connects with a base support bracket or element for supporting a wood plank between at least two of the units. Each element of the present wall jack utilizes hole-engaging connections so that a series of units can be readily joined and deployed on a variety of building or wall structures. The present unit is vertically adjustable and made of a durable steel which is resistant to weather ladened effects.

Accordingly, it is a principal object of the invention to provide a wall jack for deploying scaffolding.

It is another object of the invention to provide a wall jack for deploying scaffolding having minimized mechanical parts.

It is a further object of the invention to provide a wall jack for deploying scaffolding without the need for mechanical fasteners.

Still another object of the invention is to provide wall jack for deploying scaffolding which is easy and simple to deploy without the need for extensive levelling.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is directed to a wall jack for erecting scaffolding structures S on buildings W, preferably buildings under construction having exposed truss structures T. The preferred embodiments of the present invention are depicted in FIGS. 1–3, and are generally referenced by numerals 4*a*–4*b*, 4 and 5, respectively.

Figure 1:
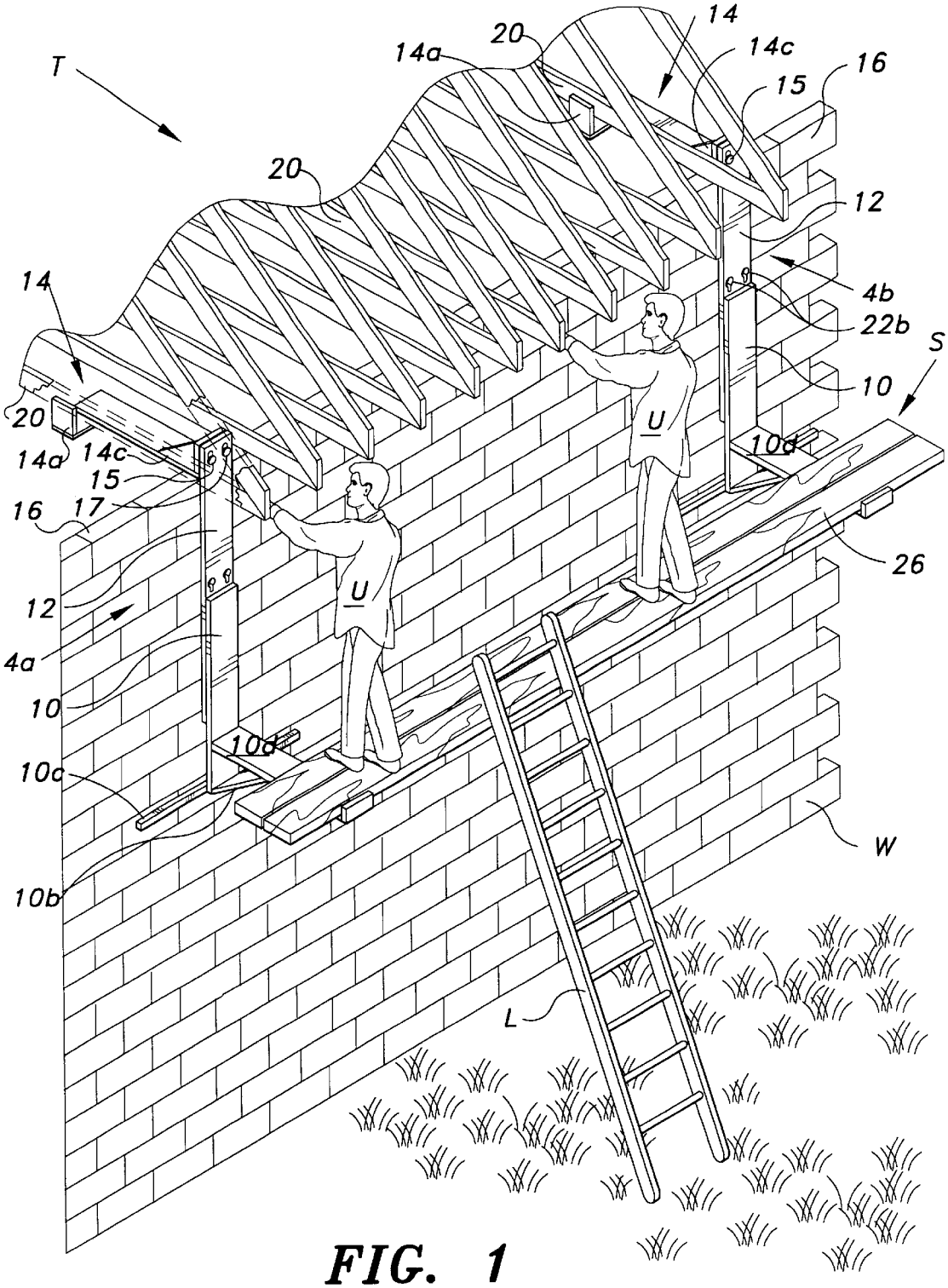
FIG. 1 is an environmental, perspective view of a wall jack according to the present invention.

As best seen in FIG. 1, wall jack units 4*a* and 4*b* are shown, each having a plurality of interconnecting support brackets or elements 10, 12 and 14. Bracket or element 14 is constructed for placement at a top wall portion 16 of a building structure W and is disposed adjacent one of joists or beams 20 of truss structure T. One end of element 14 is removably connected to wall-engaging element 12, which adjustably connects with base support element 10 having an extendable support arm 10*d* for supporting a platform, such as wood plank 26. Plank 26 has a predetermined length and is supported between at least two of the units 4*a* and 4*b* to provide user U access to a portion of the wall or building structure. Other implements can be used such as ladders L or the like to provide an access means to and from the scaffolding S without having to disassemble the erected scaffolding S.

As further shown in FIG. 1, each bracket or element 14 of wall jack units 4*a* and 4*b* has a L-shaped member 14*a* at one end and an upright plate 14*b* having male connecting prongs 15,17 at an opposite end. Element 14 also includes a horizontal plate member 14*c* that is disposed adjacent to one of the truss joists 20, while L-shaped member 14*a* engages the bottom and adjacent side of the exposed joist 20. Plate member 14*c* is of sufficient strength to reduce failure at the connection between elements 12 and 14 related to bending moments generated by a users U weight. With element 14 secured in place at the top wall portion 16, wall-engaging element 12 is connected at one end of element 14.

Figure 2:
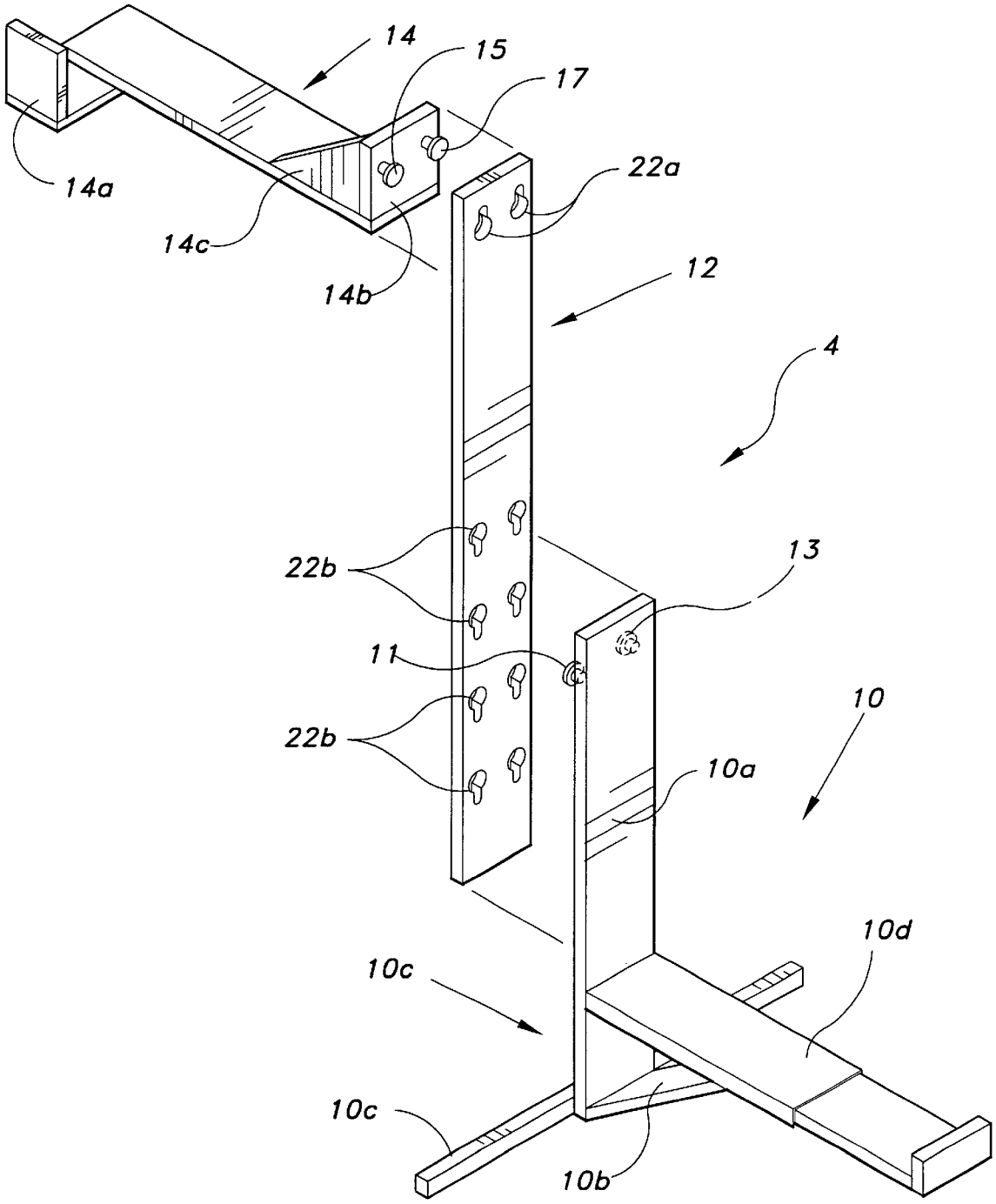
FIG. 2 is an exploded perspective view of the wall jack according to the invention.
Figure 3:
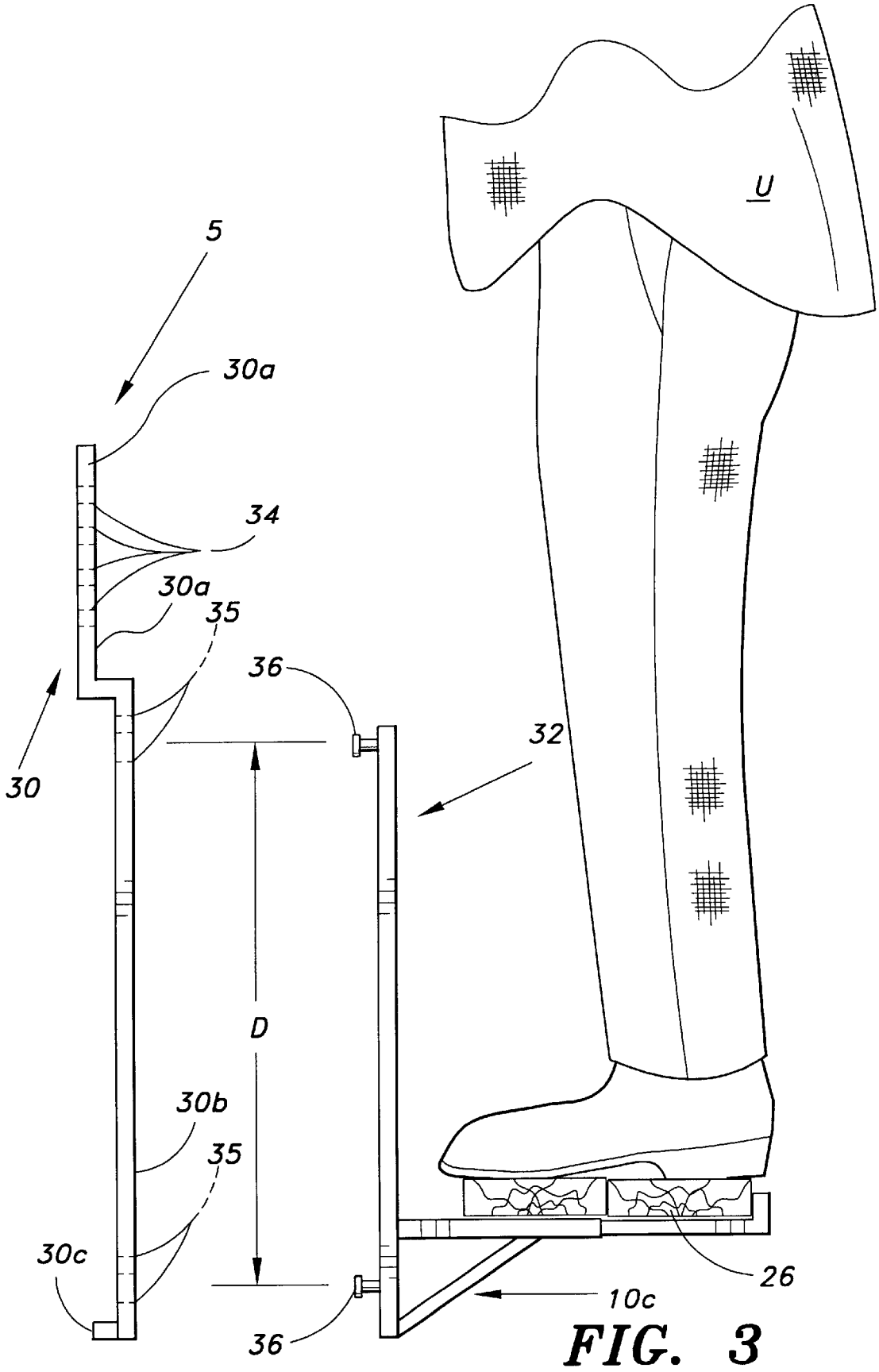
FIG. 3 is an exploded perspective view of the wall jack according to a second embodiment.

As best shown in FIG. 2, wall-engaging element 12 vertically depends from element 14 and includes a pair of apertures 22*a* adjacent its top end for removable connection with a corresponding pair of the male prongs 15,17. A paired series of apertures 22*b* are disposed below the apertures 22*a* to provide for vertical height adjustments of base support bracket or element 10.

As diagrammatically illustrated in FIG. 2, element 10 is shown in detail as a base support bracket having a vertical upright member 10*a*, a horizontally extendable support arm 10*d* and a diagonal brace member 10*b* connected to arm 10*d* and the lower end of upright member 10*a* to form an A-frame portion 10*e*. Also attached at the lower end of upright member 10*a* is a horizontally disposed bar 10*c* which serves as a stabilizer for wall jack unit 4. A set of male prongs 11 and 13 are disposed on a top portion of the upright portion 10*a* for connection to the set of apertures 22*b* to allow for predetermined height adjustments.

As diagrammatically illustrated in FIG. 3, the wall jack unit 5 is shown according to a second embodiment. The unit 5 includes support elements or brackets 30 and 32. The support bracket 30 allows for attachment to any wall portion W of a building structure via tap cans or nails (not shown) secured thereto through a set of apertures 34 without the need for roof or truss support. The support bracket 30 includes a top L-shaped portion 30*a* having the attachment apertures 34 disposed therein and a contiguous bottom portion 30*b* having a first and second set of apertures 35 separated by a predetermined distance D for attachment with a set of male prongs 36 disposed on the bracket support element 32 having the predetermined separation distance D. As with the first embodiment of the invention, the support bracket or base support element 32 includes an A-frame structure 10*e* for providing platform 26 and user U support thereon. As a complete assembly, the wall jack system according to the invention comprises at least one other wall jack unit to form a scaffolding structure S wherein the structure includes at least one platform 26 for user U access therebetween. As with both embodiments 4 and 5, the stabilizer element 10*c* and 30*c* reduce rotations thereby providing a stable scaffolding support structure. Accordingly, the wall jack system is preferably made of a durable steel material which is impervious to weather ladened effects such as rust and corrosion, etc.

It is to be understood that the present invention is not limited to the sole embodiments described above, but encompasses any and all embodiments within the scope of the following claims.

I claim:

1. A wall jack unit for erecting scaffolding structures on a wall of a building with an exposed truss structure, said wall jack unit comprising:

a joist-engaging bracket for placement at a top portion of the wall of the building, said joist-engaging bracket including a horizontal plate positionable adjacent an exposed truss joist, said horizontal plate having a L-shaped member attached at one end and an upright plate member attached at an opposite end thereof, whereby said L-shaped member engages a bottom surface and an adjacent side surface of a truss joist of the exposed truss structure;

a wall-engaging bracket vertically depending from said joist-engaging bracket, said wall-engaging bracket having a top end removably connected to the opposite end of said joist-engaging bracket and a bottom section;

means for removably connecting said joist-engaging bracket to said wall-engaging bracket;

a base support bracket including a vertical upright member having an upper end and a lower end, the upper end being removably connected to the bottom section of said wall-engaging bracket, said support bracket further including a horizontally extendable support arm and a diagonal brace member attached to said support arm and the lower end of said upright member to form an A-frame portion; and means for removably connecting said wall-engaging bracket to said base support bracket.

2. The wall jack unit according to claim 1, wherein said means for removably connecting said joist-engaging bracket to said wall-engaging bracket consists of a pair of male prongs attached to the upright plate of said joist-engaging bracket and a corresponding pair of apertures defined adjacent the top end of said wall-engaging bracket.

3. The wall jack unit according to claim 1, wherein said means for removably connecting said wall-engaging bracket to said base support bracket consists of a set of male prongs attached proximate the upper end of said vertical upright member and a corresponding series of paired apertures formed in the bottom section of said wall-engaging bracket, whereby the height of said wall jack is also vertically adjustable.

4. The wall jack unit according to claim 1, further including a horizontally disposed stabilizer bar attached at the lower end of said upright member.

5. The wall jack unit according to claim 1, further including at least one other said wall jack unit to form the scaffolding structure.

6. The wall jack unit according to claim 1, wherein said joist-engaging bracket, said wall-engaging bracket and said base support bracket are made of steel.

* * * * *